United States Patent [19]

Nelson

[11] Patent Number: 4,986,052

[45] **Date of Patent: * Jan. 22, 1991**

[54] TRUSS SETTING SYSTEM

[76] Inventor: Thomas E. Nelson, 7740 Ligonier Ct., Orlando, Fla. 32819

[ * ] Notice: The portion of the term of this patent subsequent to Nov. 7, 2006 has been disclaimed.

[21] Appl. No.: 432,487

[22] Filed: Nov. 7, 1989

Related U.S. Application Data

[63] Continuation of Ser. No. 192,228, May 10, 1988, Pat. No. 4,878,323.

[51] Int. Cl.[5] ..... E04C 3/11; E04B 7/06; E04G 21/14

[52] U.S. Cl. ..... 52/745

[58] Field of Search ..... 52/745, 262, 79.5, 92, 52/643, 127.2

[56] References Cited

U.S. PATENT DOCUMENTS

| | | | |
|---|---|---|---|
| 1,988,388 | 1/1935 | Mioton . | |
| 2,166,943 | 7/1939 | Davidson | 52/639 |
| 2,255,315 | 9/1941 | Hamilton . | |
| 3,103,709 | 9/1963 | Bolt | 52/79.5 |
| 3,172,507 | 3/1965 | Blyveis . | |
| 3,421,270 | 1/1969 | Chaney | 52/90 |
| 3,952,462 | 4/1976 | Heise | 52/62 |
| 3,959,945 | 6/1976 | Allen | 52/690 |
| 4,080,771 | 3/1978 | Weller | 52/735 |
| 4,229,915 | 10/1980 | Snow | 52/92 |
| 4,251,965 | 2/1981 | Powers | 52/262 |
| 4,327,532 | 5/1982 | Matthews | 52/92 |
| 4,704,829 | 11/1987 | Baumker, Jr. | 52/127.2 |
| 4,878,323 | 11/1989 | Nelson . | |

FOREIGN PATENT DOCUMENTS 77860 11/1948 Norway .

*Primary Examiner*—John E. Murtagh
*Attorney, Agent, or Firm*—Warren L. Franz

[57] ABSTRACT

Prefabricated metal truss units have depending set wedges and lateral notches to rapidly center them and snap them into predetermined positions over underlying substructure made up of prefabricated metal wall panels having U-shaped channel truss locks along their upper surfaces. Diagonal members centnrally pivoted to the king posts of prefabricated roof truss units have angularly oriented plumb lock elements that interconnect with king posts of adjacent units to quickly establish vertical plumbing. The tail ends of top chords are provided with soffit framework for rapid soffit plate and fascia attachment. The upper surfaces of top chords are marked to locate the first run of roof sheathing.

19 Claims, 4 Drawing Sheets

10
11
12
14
15
16
17
18
19
20
21
23
27
27'
28
34
20'
50

26
29
30
31
20
27
17
15

27
34
20
20a
14
15
20"
27'
20'
14

60
60
61
61
26
29
30
31'
20
27
53
51
52
17
15

TRUSS SETTING SYSTEM

This application is a continuation of copending application Ser. No. 192,228, filed May 10, 1988, now U.S. Pat. No. 4,878,323.

BACKGROUND OF THE INVENTION

The invention relates to a system for setting trusses in building construction; and, especially to a system for setting trusses over metal frame substructure. Although the present invention has application to the installation of trusses over substructure assembled on-site, it is particularly suited for use in building construction utilizing prefabricated substructure units, such as preassembled wall components.

In a typical such construction, a plurality of prefabricated wall panels, each comprising for example lightweight galvanized C-channel sheet steel top plate, base plate and studs welded together and joined to wall sheathing, are erected end-to-end about the peripheral margin of a concrete slab or other suitable supporting foundation. Trusses, such as inverted V-shaped trusses for establishing the framework for roofing, are then positioned above the panels at standard intervals and secured thereto. Typical trussing in such prefabricated assembly comprises planar configurations of joined top chord, bottom chord and webbing interconnecting the two, with a centrally located vertical king post serving to establish the high point or ridge of the roof. The trusses are lifted one-by-one into position above the assembled wall panel substructure, beginning at a gable end. Each truss is shifted back and forth on the top plates of the underlying wall panels until centered, then toe-nailed or riveted into fixed position after vertical leveling. During the placement process, adjacent king posts are cross braced by means of diagonals, typically extending from the top of one king post across the center of a second post to the bottom of a third post.

Each truss must be carefully leveled and positioned in order to provide the proper underlayment for sheathing and other standard-sized roof covering materials. Where plywood sheathing is used as flooring for roofing, the trusses are typically set so that sheathing is passed from the centerline of the top chord of one truss to the centerline of the top chord of another truss, with usually one truss in between, the sheathing running crosswise over the trusses. The bottom run of sheathing must be carefully positioned so that the overhang, if any, is in alignment and so that the remaining boards will be properly situated. Considerable skill and effort, to say nothing of time, is expended in achieving the required installation. Where non-prefabricated materials are utilized, the installation is accordingly even more complex.

For some construction, the top chord extends beyond the wall line to a point to be covered by fascia material, and the underside of the overhang is blocked with soffit covering. Where this is undertaken, a soffit framework is normally attached to the overhanging tail or eave ends of the top chords, necessitating the expenditure of additional skill and effort.

SUMMARY OF THE INVENTION

It is an object of the present invention to provide a truss setting system that expands the prefabricated wall panel and truss system concept to include preformed elements for positioning and aligning trusses over the substructure to make truss installation simpler and less time-consuming.

It is a further object of the invention to extend the prefabricated construction concept to provide guides for installation of roofing, as well as aids for installation of fascia and soffit materials.

In one aspect of the invention, truss locks are provided in spaced positions along the top surfaces of underlying wall structures for receiving truss elements into properly intervalled locations therein. The trusses are optionally outfitted at their tail ends with depending set wedges that act as positioning guides to center the trusses above straddled wall panels and act in cooperation with the truss locks to quickly set the trusses in correct position. In a preferred embodiment of the invention described in greater detail below, means is provided for snap fitting the distal ends of the bottom chords of the trusses into the truss locks.

In another aspect of the invention, prefabricated truss assemblies are provided with centrally pivoted diagonal members giving a factory-installed plumb lock feature for establishing bracing between the king post of each truss and the king posts of adjacent trusses. In a preferred embodiment, each diagonal member has a plumb lock element fixed in angled relationship at each of its ends to ensure proper placement of the diagonal member for the correct relative vertical orientation of adjacent trusses.

In another aspect of the invention, fascia and soffit framing materials are provided in combination with the prefabricated truss arrangements to facilitate the placement and installation of fascia and soffit materials. The upper surface of each top chord is, moreover, provided with position establishing marks to guide the placement of overlying materials, such as the first (lowermost) run of roof sheathing.

BRIEF DESCRIPTION OF THE DRAWINGS

Embodiments of the invention have been chosen for purposes of illustration and description, and are shown in the accompanying drawings, wherein.

Throughout the drawings, like elements are referred to by like numerals.

DESCRIPTION OF THE PREFERRED EMBODIMENTS

The invention is described in terms of embodiments thereof incorporated into components utilized in the construction of a building from prefabricated metal components in the form of planar elements that may be stacked horizontally (flat) for convenient delivery to the building site. The elements can be wall panels and trussing preselected and prenumbered to match the placement plan for the building to be constructed. The numbering is convenient for placing the elements directly in proximity to where they will be needed around the already prepared concrete slab or other foundation.

Figures 1, 5, 7, 9, 15:
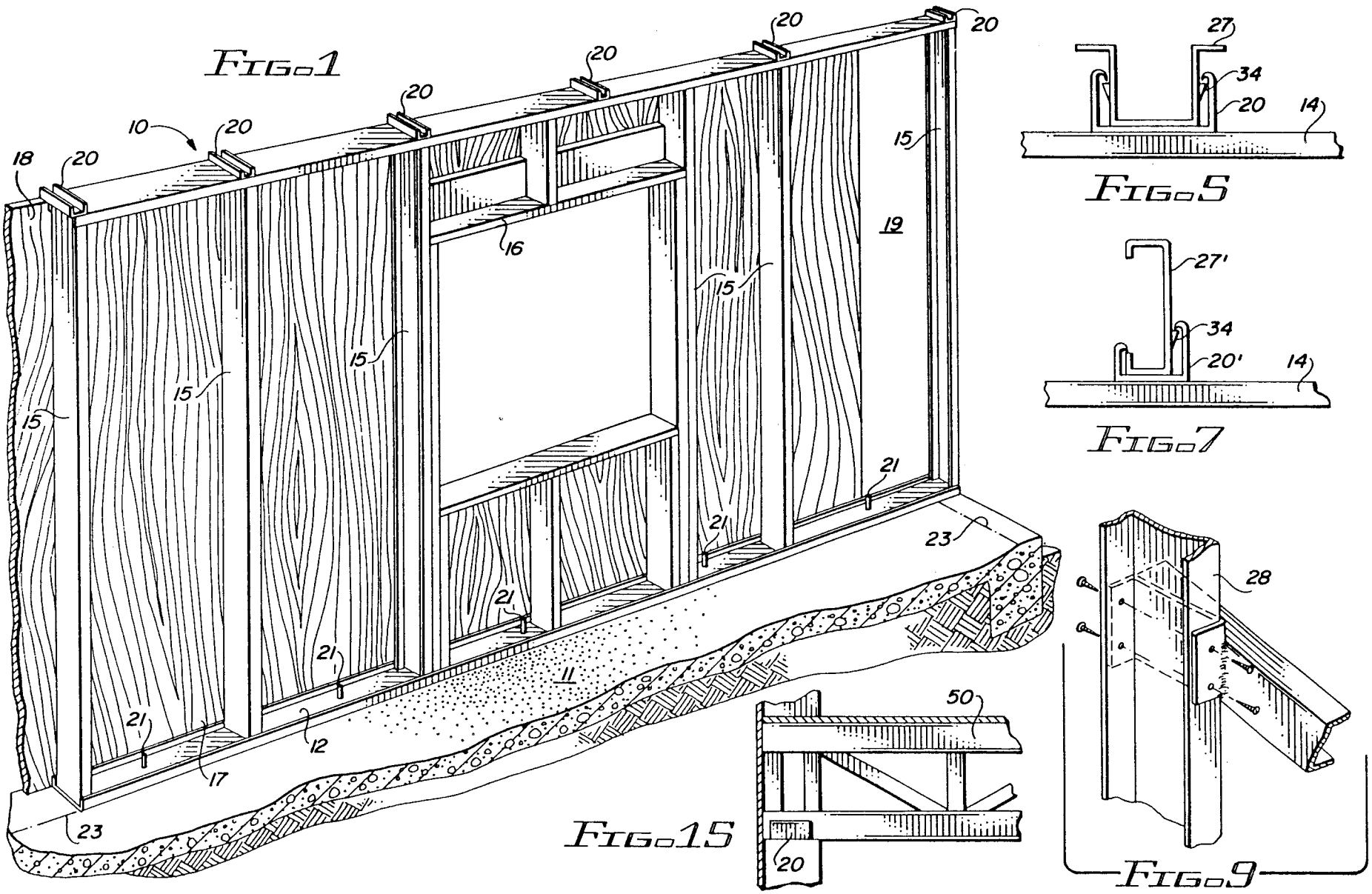
FIG. 1 is a perspective view of a standard wall panel prefabricated in accordance with the principles of the invention.
FIG. 5 is a section view of a locked truss in accordance with the arrangement of FIG. 4.
FIGS. 6 and 7 are views corresponding to those of FIGS. 4 and 5 of an alternative embodiment of locking arrangement.
FIG. 9 is an exploded, fragmentary view showing the operation of the feature of FIG. 8.
FIG. 15 is a section view taken along the line 15—15 of FIG. 14.

As shown in FIG. 1, a standard prefabricated rectangular wall panel 10 for erection over a slab 11 comprises galvanized C-shaped cross-sectioned sheet steel components, such as a horizontal base plate 12, a horizontal top plate 14 and a plurality of support studs 15 extending vertically therebetween, welded together in conventional manner to provide structural integrity to the panel 10. To suit the building plan, window framing or other elements 16 (viz. cripples, headers, jack studs, etc.) are provided in accordance with well-known techniques. The outside of the panel 10 is covered with wall sheathing, such as plywood planking 17, to complete the prefabricated unit. The sheathing is made to extend beyond the last stud 15 at one end (leftmost stud in FIG. 1) to permit an overlap 18 with a corresponding sheathingless portion 19 (right side of panel 10 in FIG. 1) of the next panel. Studs 15 are spaced at standard intervals along the panel length, except at the sheathingless end, where the last stud 15 (rightmost stud in FIG. 1) is reversed to provide a short leg to abut the first stud of an adjacent panel at that end. The panels are lightweight, to enable them to be conveniently carried by two men.

In accordance with the teachings of the present invention, the upper surface of the top plate 14 of the prefabricated panel 10 is provided with a series of truss locks 20 longitudinally spaced at intervals corresponding to the normal placement of the studs 15. Truss locks 20 for side wall panels 10 are provided in the form of generally U-shaped, elongated sheet steel channel sections placed perpendicularly to the longitudinal axis of the top plate 14, at locations above and parallel to the widths of respective studs 15. Each lock 20 (see FIG. 4) comprises a lower rectangular section and oppositely disposed rectangular side sections extending upwardly and at substantially right angles from the lateral edges thereof. The upper ends of the side sections terminate in inwardly and downwardly directed facing flanges. Truss locks 20*a* (see FIG. 2) for end wall panels 10*a* may be of identical construction to those of the side wall panels 10, except that, for reasons which will become more fully apparent below, the 20*a* are placed in parallel with the axis of the locks top plate 14. The locks 20, 20*a* are fixed to the wall panel top plates 14 by conventional fastening means, and are preferably affixed thereto before delivery to the construction site as part of the prefabrication process.

Figures 3, 4, 6, 12, 13:
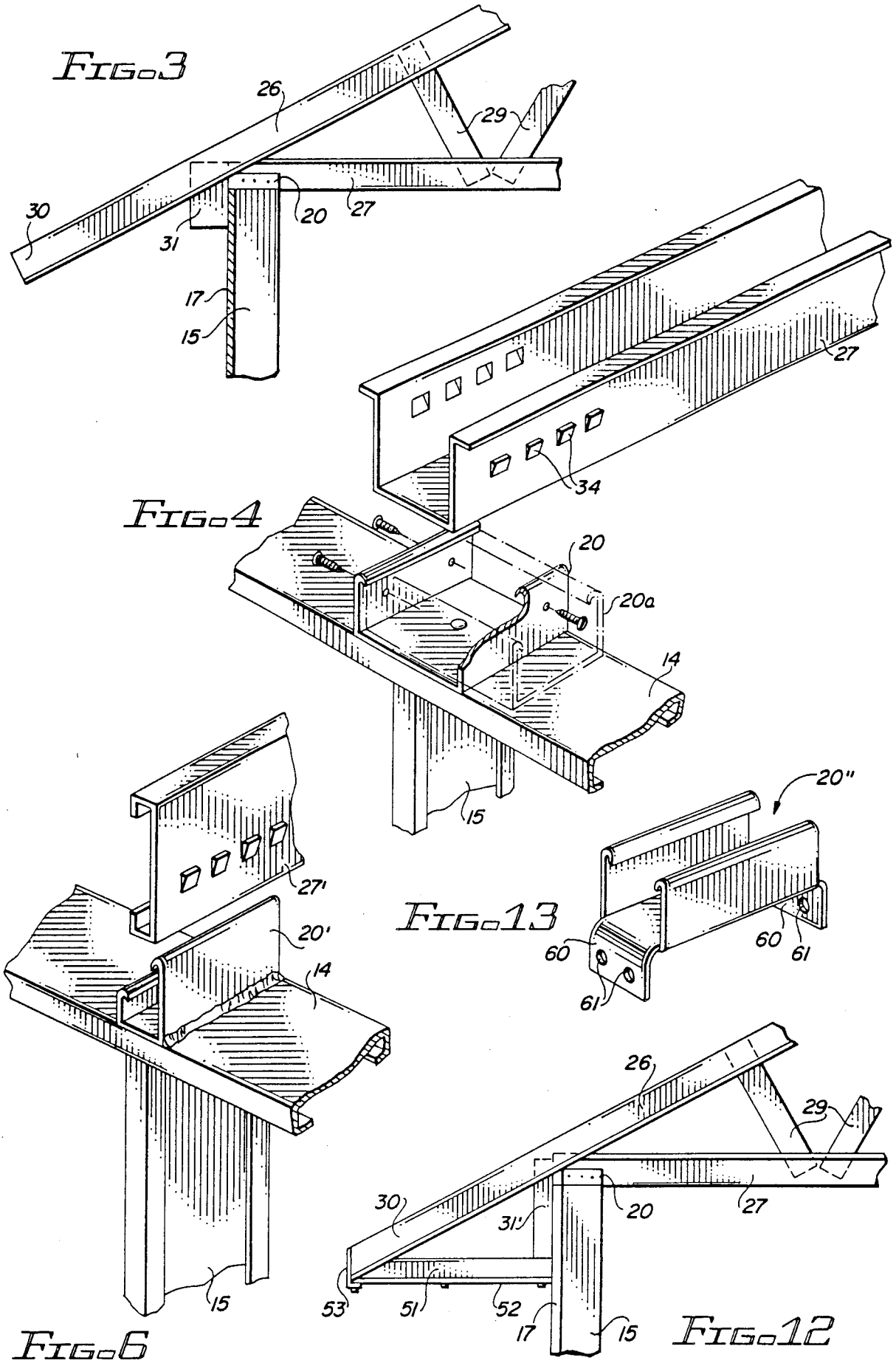
FIG. 3 is a fragmentary section view taken along the line 3—3 in FIG. 2.
FIG. 4 is an exploded, fragmentary, partially cut away view showing the truss locking arrangement of the system of FIGS. 1–3.
FIG. 12 is a view corresponding to that of FIG. 3 showing fascia and soffit framing components incorporated with the trusses.
FIG. 13 is a perspective view of a truss locking component for use with wooden substructure.

FIG. 4 shows a truss lock fastened to a top plate 14 by means of a loose, centrally located rivet to provide a pivotal means of attachment that permits the same lock to serve as the lock 20 of a side wall panel 10 by placing it in the solid position shown in FIG. 4, or to serve as the lock 20*a* of an end wall panel 10*a* by rotating it 90° to the dot-and-dash position. This has the advantage that similarly dimensioned side and end wall panels may be made interchangeable, as compared with attachment by welding or other rigidly positioning means (see, e.g. FIG. 6) which requires predesignation of which panels are side wall panels 10 and which are end wall panels 10*a*. Of course, truss locks 20*a* may be dispensed with altogether for end panels 10*a*, if desired, or may be replaced by simple rectangular plates (not shown) projecting upwardly in vertical, flush positions along the inner or outer longitudinal edge of the plate 14.

As a first step in the erection of the building, the previously prepared slab 11 is checked for squareness, flatness and proper dimensioning. A plurality of anchor bolts 21 protrude upwardly along the peripheral margin of the slab 11 where the panels 10 are to be installed. A chalk line 23 is struck along each edge of the slab 11, for the width of the panels 10, to serve as a guide for their erection. Squareness of the chalk lines must be verified.

The panels 10 are installed one after another with the inside (interior side) of the panel placed directly over the chalk line 23. A foam or heavy bead of caulking is applied to the slab as a sill seal before each panel is installed. Beginning panel installation from a corner has the advantage of providing a self-supporting freestanding unit from which the remaining installation may proceed. The first corner panel 10 (FIG. 1) is rested on top of the anchor bolts 21, with the inside edge of the panel aligned directly above the chalk line 23. The base plate 12 which forms the bottom track of the panel 10 is tapped causing dimples to form, to identify the locations of the underlying anchor bolts 21. After ascertaining that the base plate 12 is centered in proper position over the anchor bolts 21, a socket can be placed over the respective dimples and struck to cause the bolts 21 to pierce the plate 12, causing the panel 10 to drop into position atop the marginal edge of the slab 11. Anchoring is accomplished by threading nuts above washers onto the anchoring bolts 21, and tightening. The process is repeated for the second corner panel (not shown in FIG. 1) and the corners of the adjacently installed panels are clamped prior to tightening the anchor bolts of the second panel. When proper positioning has been verified, the corner studs 15 are fastened together by conventional means, such as panhead self-drilling screws or the like.

The balance of the panels 10 is then installed using the same procedure, with the end studs 15 of respective adjacent panels being clamped and fastened together. Plywood sheathing 17 is then applied at the sheathingless ends 19 of the corner panels 10 (see FIG. 1), and the extension sheathing 18 on the straight-run laps is fastened to the corresponding sheathingless ends of adjacent straight-run panels. Squareness and plumbing are periodically checked and rechecked throughout installation.

Installation of roof trussing above the erected wall panels 10 is illustrated with reference to FIG. 2. As with the panels 10, trussing is delivered to the construction site in the form of a plurality of preassembled planar truss units 25. With conventional installations utilizing preassembled truss units, a worker had to "walk the walls" to properly position the units and thereafter tie them together. With units 25 in accordance with the system of the invention, the erection of trussing is much more simple.

Each planar panel 25 has a generally isosceles triangular configuration, with diagonally extending top chords or roof rafters 26 constituting the sides and arranged to converge at a peak, and a horizontally extending bottom chord or joist 27 constituting the base and arranged to connect facing lower surfaces adjacent the top chord free ends. A king post 28 extends vertically between the inside of the peak and a top surface at the midpoint of the bottom chord. A plurality of webbing members 29 (shown in dot-and-dashed lines in FIG. 2 and in solid lines in FIG. 3) extends in a criss-cross diagonal pattern to form struts, queen posts, etc. in the interior of the unit between facing surfaces of the top chords 26 and the bottom chord 27. As is customary, the free ends of the top chords 26 extend beyond their junctures with the bottom chord 27 to provide tail or eave overhangs 30. For reasons that will become apparent, set wedges 31 are provided to depend from the units 25 at the outsides of the junctures of the chords 26 with the chord 27. Truss units 25 are of lightweight steel construction, easily lifted up to straddle opposite wall panels 10.

Truss units **25*a* for the gable ends of the building above the end walls of the substructure have webbing 29 that, rather than crisscrossing as in the midroof trusses, takes the form of vertical cripples 33 to one side of which sheathing or other covering material can be attached in accordance with well established principles. The end units 25*a*** may have sheathing applied at the factory as part of the prefabrication, unless they are exceptionally long. If not already sheathed, they can be sheathed at the construction site prior to being raised into place.

Truss installation begins by raising a gable end truss unit **25*a* above one end wall of the already assembled substructure. The truss 25*a* is raised up onto the top track of the end wall and oriented with its bottom chord 25 aligned with the top plates 24 of the underlying end wall panels 10*a*. The unit is moved longitudinally until set wedges 31 depending at the outside of each chord 26, 27 juncture come down just beyond the end wall corners, thereby dropping the truss into a properly centered position without the necessity for coordinated back and forth activity between a worker walking the walls and one on the ground, typical of prior art truss installations. At this point, the truss is centered and resting on the tops of the end wall panel truss locks 20*a*. The truss is then given a series of downward thrusts to bring the lateral edges of the bottom chord 27 between the inwardly extending flanges and down into the channels of the locks 20*a*. Once in place, the unit 25*a* is then fastened to the tops of the wall panels 10*a* and the locks 20*a* by suitable conventional means, such as panhead self-drilling screws or the like, and temporarily braced to maintain a vertical position while adjacent units 25** are brought into position.

Figures 2, 8:
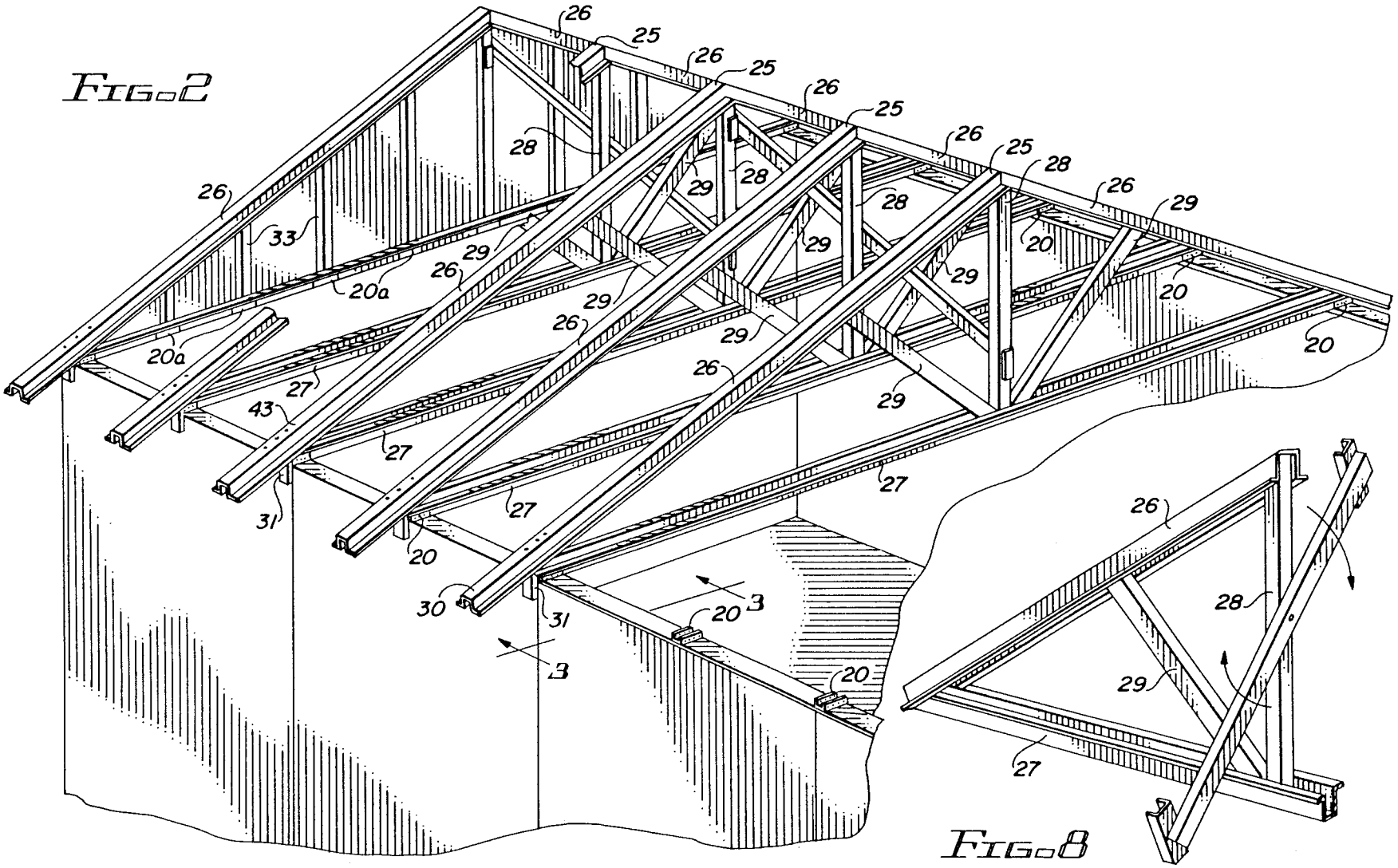
FIG. 2 is a perspective view of the truss setting system of the invention being utilized with the panel of FIG. 1.
FIG. 8 is a perspective view of a portion of one of the trusses of FIG. 2 showing the plumb locking feature of the system.

Each remaining truss unit 25 is then raised up above the opposing side wall panels 10, so that a set wedge 31 depending from the unit 25 at each intersection of top chord 26 with bottom chord 27 falls outside the exterior wall of each opposite panel 10 (see FIGS. 2 and 3). The wedges 31 are prepositioned and welded to the units 25 to insure proper centering of the truss units 25 above the substructure. The bottom chords 27 are then aligned with respective oppositely-positioned, perpendicularly oriented truss locks 20 of the side wall panels 10, and snapped into place.

The components of the truss members 25 may be constituted by lightweight galvanized C-channel sheet steel elements similar to those employed for the wall panels 10. The embodiment of truss units shown in FIGS. 2 and 3, however, advantageously utilizes extruded "top hat" channel sheet steel elements. Such elements are of generally inverted "U"-shaped right angular cross-section with perpendicularly outwardly projecting flanges at the free lower edges of the channel. The unit 25 construction shown in FIG. 2, utilizes top hat channel elements for the top chords 26, and inverted top hat channel elements for the bottom chord 27. Conventional C-channel elements can then be utilized for the king posts 28 and webbing members 29 in a convenient manner that permits them to extend between and into the opposing central openings of the facing top and bottom chords 26, 27 and be secured therein by welding or other conventional attachment means. Likewise, the set wedges 31 are preferably of C-channel sheet steel construction and are fitted to depend vertically down from the channel openings of the top chords at positions just outwardly of the spacing of the opposing wall panels 10 of the underlying substructure. To perform their intended truss centering function, the set wedges 31 depend for a convenient distance beyond the undersurface of the bottom chord 27.

A snap fitting locking arrangement for locking top hot cross-sectioned truss members within truss locks 20 is illustrated in FIGS. 4 and 5. For C-shaped cross-sectioned components, a snap fitting arrangement is illustrated in FIGS. 6 and 7. In each case, the bottom chords 27 are shown notched at points of intended attachment to the locks 20 to provide outward protrusions 34 on the side surfaces thereof which cooperate with the inwardly directed flanges formed on the truss locks 20 to lock the truss in position.

For the top hat arrangement shown in FIGS. 4 and 5, the truss locks 20 for side wall panels 10 take the form of U-shaped channels positioned perpendicularly to top plates 14 above the studs 15, at intervals corresponding to standard truss spacing. The upward extending sides of each truss lock 20 terminate in inwardly and downwardly directed flanges, as already described, which are dimensioned and configured to catch and retain the outward projections of the notches 34 formed externally on the corresponding surfaces of the bottom chords 27 of the trusses 25. The tolerances between the dimensions of the trusses 25 and the dimensions of the locks 20 serve to provide a snap fit. The flanges are rounded at their lines of attachment with the side walls of the locks, and the protrusions 34 are tapered outwardly toward their upper extents, so that forcing the chord 27 down onto the locks 20 spreads the sides of the locks apart to permit downward passage of the protrusions 34 and return of the sides to their normal configuration once the notches pass below the flanges. This provides a snap fit that captures the chord 27 within the locks 20. The locking mechanism works similarly between the chord 27 of end truss **25*a* and the parallelly positioned locks 20*a*** of the end wall panels.

FIGS. 5 and 6 show a similar snap locking arrangement for use with truss units comprised of standard C-shaped cross-sectional sheet steel members. The locks 20' for retaining the C-shaped sectional chord 27 in place differ from the locks 20 previously described, however, by providing an upwardly extending leg similar to that shown in FIGS. 3 and 4 on only one side of the lock 20' The opposite side has a shorter upwardly extending leg that catches the upwardly extending flange of the C-shaped cross-section itself. The longer leg catches the notches 32 on the intermediate surface the same way as described with reference to FIGS. 3 and 4. Each lock 20 is fastened, such as by welding to the top plate 14 at the appropriate location. As indicated in FIG. 3, screws 38 may be applied after the snap fit has occurred to further strengthen the truss connection.

The positioning and fastening of trusses 25 is thus accomplished without the requirement for detailed centering measurements and with no need for applying nails or other driven fasteners, except as desired for supplemental stability. As an added assistance to truss installation, each truss 25 is provided with a preinstalled plumb lock feature, as shown in FIGS. 2, 8 and 9.

Normally, in the installation of a roof truss framework, adjacent trusses are propped into vertical position, then held rigidly upright by fastening diagonal bracing members passing transversely between them. The relative positions of the trusses may also be established by ridge board members passing perpendicularly between them at their apex ends. The temporary bracing and installment of diagonals, such as between adjacent king posts, can be a very time consuming and exacting task. The provision of plumb locks in accordance with the principles of the system of the invention offers great convenience and time savings.

The center of each truss unit 25 is provided with an elongated diagonal member 40 attached for rotation about a central pivot point 41 on the king post 28 (FIG. 8). At each end of the diagonal 40, a plumb lock 42 is welded in fixed position, oriented at a predetermined angle relative to the axis of the diagonal 40.

As shown in the embodiment of FIGS. 2, 8 and 9, the diagonal may take the form of a C-channel sheet steel member cut to a length for extension from a point near the top of the king post 28 of the adjacent truss 25 on one side, to a point near the bottom of the king post 28 of the adjacent truss 25 on the other side of the truss 25 to which the diagonal 40 is mounted. The diagonal is attached at the center of the underside of the channel by a rivet, or other conventional pivotable attachment, to the underside of the channel of a C-channel sheet steel king post member whose width is placed to run perpendicularly to the plane of the truss unit. The connection is made sufficiently tight so that there is not too much lateral play of the diagonal as it is brought into locking position, but with just enough "wobble" so that each plumb lock 42 can be maneuvered into position around the adjacent truss king post. As shown in FIG. 9, the plumb lock 42 may be a short elongated run of channel welded adjacent an end of the diagonal 40 at an angle such that when the diagonal is pivoted to bring the center of the channel into standard truss interval spacing, the channel axis will be vertical. Thus, when the respective channels are brought into locking contact with the respective adjacent truss king posts, the relative vertical orientation of the plumb lock truss and the adjacent trusses will be ensured.

As already mentioned, the angles of the plumb locks 42 are chosen so that the diagonal 40 may be pivoted into position with one plumb lock 42 at one end received vertically in alignment adjacent the top of the king post 28 of one adjacent truss member 25 and the other plumb lock 42 at the other end of the diagonal 40 received in vertical alignment adjacent the bottom of the king post 28 of the other adjacent truss member 25.

During the truss installation procedure, after a truss has been locked into place with its bottom chord 27 within locks 20, the plumb lock diagonal 40 is swung out as shown by the arrows in FIG. 8 and its plumb lock ends are brought into engagement with the king posts of adjacent truss units. The gable end trusses **25*a* can either be provided with no diagonal member 40, or can be provided with a half-length member that has a plumb lock 42 at only one end. The plumb lock will be forced between the sheathing and the king post 28 on the gable end for plumb. The angle of the plumb lock which is welded in place, forces the gable to be plumb when it is installed. As will be appreciated, the interconnection between the plumb locks 42 and the king posts 28 may optionally be accomplished by a snap fitting arrangement like those shown for the bottom chords 27 and locks 20 in FIGS. 4–7. Once in place, as shown in FIG. 9**, self-drilling panhead screws or other fasteners may be utilized to increase the rigidity of the attachment.

The gable end truss, as already mentioned, is initially braced into vertical position. A second and third truss are then raised above the structure and locked into their respective positions by the locks 20. The plumb lock diagonal member 40 of the second truss can then be swung into position to lock its plumb lock 42 ends on the gable end truss and the third truss. This sets the vertical for the second and third trusses relative to the braced end truss. The balance of the trusses 25 are then installed in like manner, except that it will not be necessary to check the plumb on each truss. When the next truss is lifted into place, the preceding truss's plumb lock 42 is extended to offer a guide for the new truss. The truss is slid until the plumb lock is engaged on the king post 28. Fasteners can then be installed on both sides of the plumb locks as indicated in FIG. 9. When the last non-end truss 25 has been installed, its plumb lock 42 will aid in the installation of the other gable end, whose installation follows the same procedure as that of the first gable end, except that the plumb lock 42 of the adjacent non-end truss will be located at the bottom of the gable end king post instead of the top as it was for the first gable.

Figure 10:
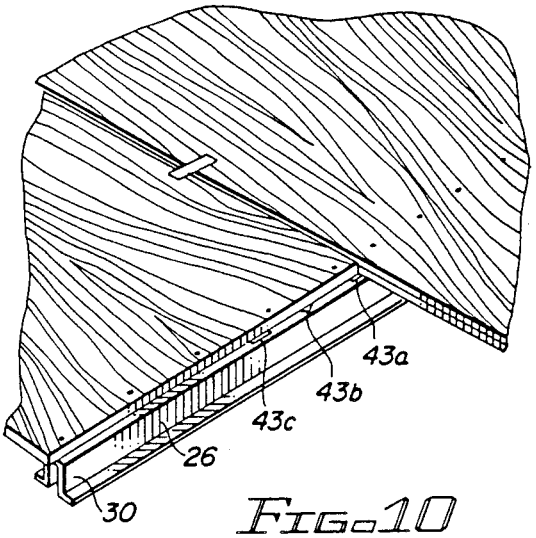
FIGS. 10 and 11 are views of sheathing being applied to the trussing of FIG. 2.
Figure 11:
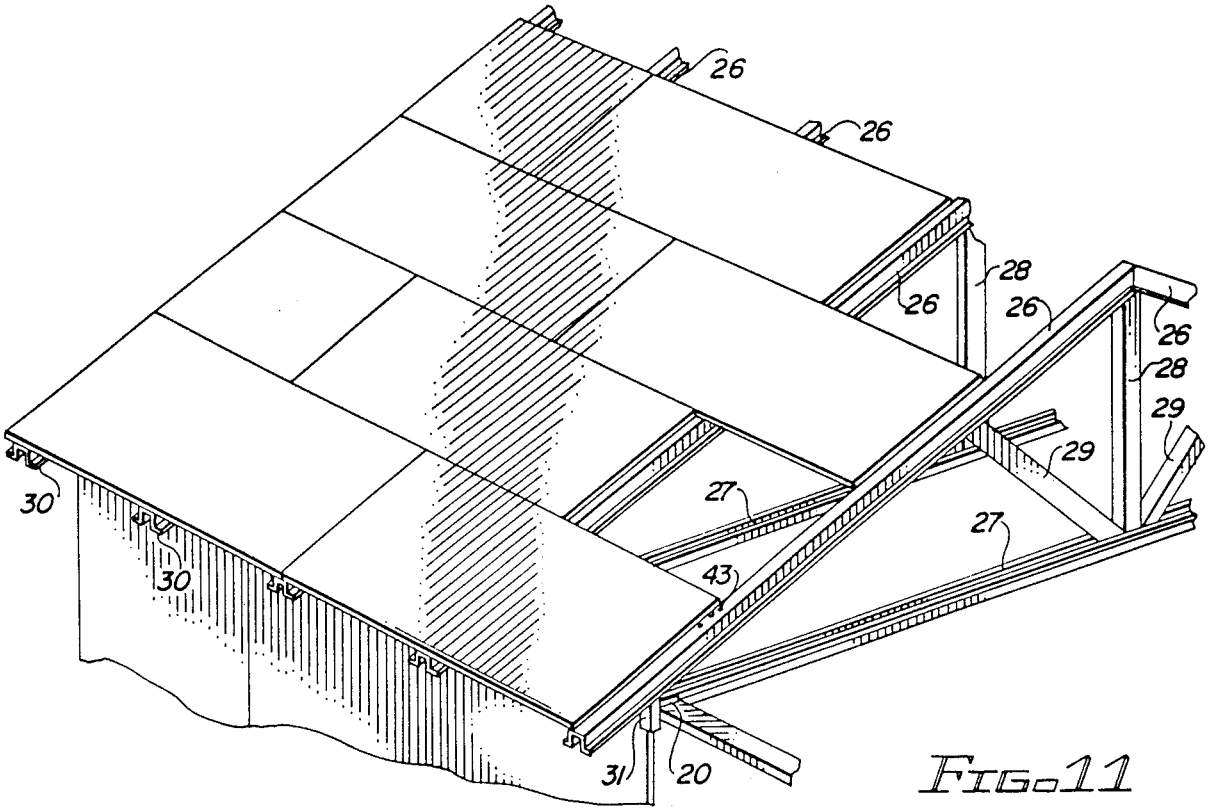

As shown in FIGS. 10 and 11, once installation of the trusses is complete, sheathing or other roofing material is overlaid on the top chords 26 of the truss members 25. The units 25 have advantageously been premarked to properly locate the first row of plywood. As shown in FIGS. 10 and 11, indicia 43, in the form of dimples, scoring marks, or the like, show the location of the first run. Various different shapes such as circles **43*a*, diamonds 43*b*, squares 43*c***, etc., can be used at different spacings from the top chord ends to indicate the start run positions for covering materials of different widths, or for different appearances. It should be noted that for a top hat cross-sectional steel chord configuration, each truss has a full two-inch top chord with which to aid in plywood layout.

The lower ends of chords 26 of the roof truss members 25 may be modified, as shown in FIG. 12, to provide soffit framework 50. Such framing may be constituted by extended set wedges 31' which depend to a point horizontally in line with the bottom extremity of the chord 26 tail, and welding horizontal soffit supporting struts 51 thereto to extend normally outward from the sheathing 17 to the bottom of the chords 26. Rectangular soffit sheets 52 may then be brought over the struts 51 after truss installation to enclose the eaves portion of the roof, and optional vertically disposed fascia sheet material segments 53 may be fastened to the terminal ends of the chords 26, as shown.

As will be appreciated by those skilled in the art to which the invention relates, many of the benefits and advantages of the present invention can also be realized when the same principles are applied to wood construction substructure. FIG. 13 shows a truss lock bracket 20'' suitable for attachment at the junctions of top plates and studs in conventional wood structure walls. The lock 20'' has the general configuration of the lock 20 previously described but includes downwardly depending attachment flanges 60 at the channel ends having apertures 61 through which nails or other fasteners may be brought for attachment to the wooden walls. A metal truss roof of the type described can then be conveniently and quickly erected atop the wooden substructure thus prepared with locks 20''.

Figure 14:
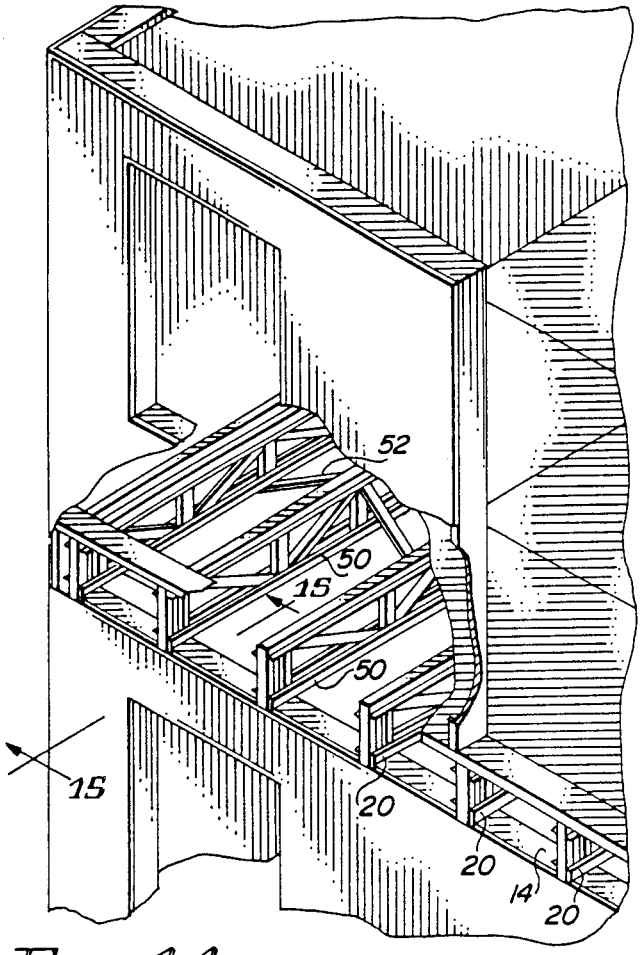
FIG. 14 is a perspective view showing the installation of trussing between floors in a multi-storied building utilizing the system of the invention.

For multi-storied buildings, the truss lock system of the invention may also be used to install floor joist trusses 50 as illustrated in FIGS. 14–15. The manner of installation proceeds as before, the bottom run of each truss member being locked by means of a snap fitting engagement as in FIGS. 4 and 5, or 6 and 7, to locks 20 of underlying substructure walls. Bridging 52 between adjacent trusses 50 may likewise be accommodated to incorporate a pivoting diagonal member similar to the diagonal member 40 shown in FIGS. 2, 8 and 9.

Those skilled in the art will also appreciate that various other substitutions and modifications other than those already mentioned may also be made to the embodiment described above, without departing from the spirit and scope of the present invention as defined by the claims appended hereto.

What is claimed is:

1. A method for setting trusses in construction of a building at a site, comprising the steps of:

preparing a slab on site, said slab having a plurality of anchor bolts protruding upwardly along a peripheral margin of said slab;

prefabricating, off site, a plurality of rectangular wall panels, each panel having an elongated top plate with an upper surface, an elongated bottom plate extending parallel to and spaced from said top plate, a plurality of studs transversely positioned to extend at longitudinally spaced intervals between said plates, and a series of truss locks formed with channels located at longitudinally spaced intervals along said upper surface;

prefabricating, off site, a plurality of roof truss units, each having a generally triangular configuration with elongated top chords arranged to extend diagonally from free ends to converge at a peak, and an elongated bottom chord extending horizontally to connect points adjacent said free ends of said top chords;

transporting said off-site prefabricated panels and units to said site;

erecting said panels, on site, in opposing upright positions on said slab over said anchor bolts to form opposite walls of a building structure; and raising said units up to straddle said erected walls, with opposite ends of said bottom chords captured within respective opposing ones of said channels, said spacing intervals serving to space said units.

2. A method as in claim 1, wherein said channel spacing intervals correspond to standard spacing of trusses in conventional building construction, and said channels are located above said studs. comprises locking said ends in captured positions using said snap fit means.

3. A method as in claim 1, wherein said truss locks are generally U-shaped, channel sections each having a rectangular base and oppositely disposed rectangular sides extending upwardly and at substantially right angles from lateral edges of said base.

4. A method as in claim 3, wherein the tops of said oppositely disposed sides are rounded and terminate in inwardly and downwardly directed facing flanges, and the ends of said chords have outwardly and upwardly tapered protrusions; and wherein, during the raising step, said chords are pressed into said truss locks so that said flanges yield outwardly in response to contact with said protrusions, then return above said protrusions to their previous positions, to snap lock said chords into their captured positions.

5. A method as in claim 4, wherein said chords comprise top hat channel sheet steel elements, and said protrusions comprise notches formed on side surfaces of said chords.

6. A method as in claim 1, wherein each of said prefabricated units has a set wedge depending adjacent each said chord; and said raising step further comprises centering said units above said straddled walls by setting said set wedges down at positions outwardly of distal edges of said top surfaces of respective oppositely erected wall panels.

7. A method as in claim 1, wherein said top chords have said top surfaces which are premarked with indicia; and wherein said method further comprises the step of applying roof sheathing over said raised roof truss units using said indicia to identify the location for applying a first run of said roof sheathing.

8. A method as in claim 7, wherein said indicia comprise indicia of different shapes located at different spacings from said free ends of said top chords.

9. A method as in claim 1 wherein said truss units are prefabricated to each have a pivotal member mounted to pivot about a pivot point on said unit; and wherein said method further comprises the step of establishing a vertical plumb for each of said units relative to an adjacently positioned unit by pivoting said pivotal member to make a rigid, diagonal connection between said pivot point on said unit and a vertically displaced point on said adjacently positioned unit.

10. A method as in claim 9, wherein each said unit further comprises a post extending vertically between said peak and a point intermediate the ends of said bottom chord; and wherein said pivotal member comprises an elongated diagonal member pivotally attached to said post, and a plumb lock having a plumb channel with an axis located adjacent each end of said diagonal member; and wherein said plumb establishing step comprises pivoting said diagonal member so that when said plumb channel axis of said plumb lock of one end of said diagonal member is brought into vertical orientation relative to said post, said plumb channel axis of said plumb lock of the other end of said diagonal member is likewise brought into corresponding relative vertical orientation.

11. A method as in claim 10, wherein each pivotal member further comprises snap fit means for locking said plumb locks; and said plumbing step further comprises locking said plumb locks to the posts of adjacently positioned units using said snap fit means.

12. A method as in claim 6, wherein each of said prefabricated units further comprises a post extending vertically between said peak and a point intermediate the ends of said bottom chord, and means mounted on said post for automatically establishing a vertical plumb of said post relative to the corresponding post of an adjacently positioned unit; and said method further comprises the step of plumbing said raised units using said plumb establishing means.

13. A method as in claim 10, wherein said plumb establishing means comprises an elongated diagonal member pivotally attached to said post, and a plumb lock located adjacent each end of said diagonal member and formed with a plumb channel having an axis; and wherein said plumbing step comprises pivoting said diagonal members respectively so that the plumb channel axes of the plumb locks of the ends of said diagonal members are brought into vertical orientation relative to the corresponding posts of oppositely positioned adjacent units.

14. A method as in claim 13, wherein each said prefabricated unit further comprises snap fit means for locking said plumb locks to said posts of said adjacently positioned units; and said plumbing step further comprises locking said plumb locks to said posts using said snap fit means.

15. A method for setting trusses in construction of a building at a site, comprising the steps of:

prefabricating, off site, a plurality of wall panels, each having an elongated top surface and a series of truss locks formed with channels located at longitudinally spaced intervals along said top surface;

prefabricating, off site, a plurality of truss units, each having an elongated chord;

transporting said off-site prefabricated panels and units to said site;

erecting said panels, on site, in opposing upright positions to form opposite walls of a building structure; and raising said units up to straddle said erected walls, with opposite ends of said chords captured within respective opposing ones of said channels, said spacing intervals serving to space said units;

wherein at least one of said pluralities of prefabricated panels and units includes snap fit means for locking said ends of said chords within said channels, and said raising step includes locking said ends in captured positions using said snap fit means.

16. A method for setting trusses in construction of a building at a site, comprising the steps of:

prefabricating, off site, a plurality of wall panels, each having an elongated top surface and a series of truss locks located at longitudinally spaced intervals along said top surface; said truss locks being generally U-shaped, channel sections each having a rectangular base and oppositely disposed rectangular sides extending upwardly and at substantially right angles from lateral edges of said base;

prefabricating, off site, a plurality of truss units, each having an elongated chord;

transporting said off-site prefabricated panels and units to said site;

erecting said panels, on site, in opposing upright positions to form opposite walls of a building structure; and raising said units up to straddle said erected walls, with opposite ends of said chords captured within respective ones of said channels, said spacing intervals serving to space said units;

wherein said plurality of wall panels comprises a plurality of side wall panels and said channel sections of said side wall panels are arranged with channel axes set perpendicularly to the respective longitudinal axes of said top surfaces, said erecting step comprises erecting said side wall panels to form side walls, and said raising step comprises raising ones of said units up to straddle said erected side walls; and wherein said method further comprises the step of prefabricating, off site, a plurality of end wall panels, each having an elongated end top surface and a series of end truss locks formed with channels located at longitudinally spaced intervals along said end top surface, said end truss locks being generally U-shaped, channel sections arranged with their channel axes set parallel to the respective longitudinal axes of said end top surfaces; the step of transporting said off-site prefabricated end wall panels to said site; the step of erecting said end wall panels, on site, to form opposite end walls of the building structure; and the step of raising others of said units up to respectively extend longitudinally of said top surfaces of said erected end walls, with the lengths of said chords of said other units being captured within respective adjacent ones of said channels.

17. A method for setting trusses in construction of a building at a site, comprising the steps of:

prefabricating, off site, a plurality of wall panels, each having an elongated top surface and a series of truss locks formed with channels located at longitudinally spaced intervals along said top surface;

prefabricating, off site, a plurality of truss units, each having an elongated chord;

transporting said off-site prefabricated panels and units to said site;

erecting said panels, on site, in opposing upright positions to form opposite walls of a building structure; and raising said units up to straddle said erected walls, with opposite ends of said chords captured within respective opposing ones of said channels, said spacing intervals serving to space said units;

wherein said prefabricated panels have inner and outer surfaces; and said method further comprises the step of attaching sheathing, off site, to said outer surface, said sheathing extending for an extended sheathing length beyond an end of each said panel and falling short for a complementary sheathingless length of an opposite end of each said panel, so that an overlap between the extended sheathing length of one panel and the sheathingless length of an adjacent panel is achieved when two of said panels are brought into end-to-end, longitudinally aligned relationships during said erecting step.

18. A method for setting trusses in construction of a building at a site, comprising:

prefabricating, off site, a plurality of wall panels, each having an elongated top surface, and a series of truss locks formed with channels located at longitudinally spaced intervals along said top surface;

prefabricating, off site, a plurality of truss units, each having an elongated chord, and a set wedge depending adjacent each end of said chord;

transporting said off-site prefabricated panels and units to said site;

erecting said panels, on site, in opposing upright positions to form opposite walls of a building structure;

raising said units up to straddle said erected walls, with opposite ends of said chords captured within respective opposing ones of said channels, said spacing intervals serving to space said units; and centering said units above said straddled walls by setting said set wedges down at positions outwardly of distal edges of said top surfaces of respective oppositely erected wall panels.

19. A method as in claim 18, wherein at least one of said pluralities of panels or units further comprises snap fit means for locking said ends of said chords within said channels, and said raising step further comprises locking said ends in captured positions using said snap fit means.

* * * * *